US007764262B2

(12) United States Patent
Lee

(10) Patent No.: US 7,764,262 B2
(45) Date of Patent: Jul. 27, 2010

(54) LIQUID CRYSTAL DISPLAY DEVICE AND METHOD OF DRIVING THE SAME

(75) Inventor: Min-Kyung Lee, Gyeongsangbuk-Do (KR)

(73) Assignee: LG Display Co., Ltd., Seoul (KR)

( * ) Notice: Subject to any disclaimer, the term of this patent is extended or adjusted under 35 U.S.C. 154(b) by 880 days.

(21) Appl. No.: 11/646,247

(22) Filed: Dec. 28, 2006

(65) Prior Publication Data

US 2007/0216632 A1 Sep. 20, 2007

(30) Foreign Application Priority Data

Mar. 20, 2006 (KR) ..... 10-2006-0025222

(51) Int. Cl.
*G09G 3/36* (2006.01)

(52) U.S. Cl. ..... 345/99; 345/94

(58) Field of Classification Search ..... 345/87–89, 345/94, 96, 98, 99, 100, 204, 209
See application file for complete search history.

(56) References Cited

U.S. PATENT DOCUMENTS 4,914,468 A * 4/1990 Naruse et al. ..... 356/215
6,840,622 B2 * 1/2005 Kutschbach et al. ..... 351/200
2002/0024494 A1 * 2/2002 Hector et al. ..... 345/92
2004/0158662 A1 * 8/2004 Konda et al. ..... 710/72

FOREIGN PATENT DOCUMENTS

JP 8-248385 A 9/1996
WO WO-2004/021322 A2 3/2004

* cited by examiner

*Primary Examiner*—Ricardo L Osorio
(74) *Attorney, Agent, or Firm*—Birch, Stewart, Kolasch & Birch, LLP

(57) ABSTRACT

A liquid crystal display device includes a liquid crystal panel; a $m^{th}$ gate line, a $(m+1)^{th}$ gate line, a $(m+2)^{th}$ gate line and a $(m+3)^{th}$ gate line in the liquid crystal panel, wherein m is a natural number; at least one data line crossing the $m^{th}$ gate line, the $(m+1)^{th}$ gate line, the $(m+2)^{th}$ gate line and the $(m+3)^{th}$ gate line; a timing controller generating a data signal, a control signal, a first flicker signal and a second flicker signal; a gate driver generating a $m^{th}$ gate signal and a $(m+2)^{th}$ gate signal using the first flicker signal and generating a $(m+1)^{th}$ gate signal and a $(m+3)^{th}$ gate signal using the second flicker signal, the $m^{th}$ gate signal and the $(m+2)^{th}$ gate signal being supplied to the $m^{th}$ gate line and the $(m+2)^{th}$ gate line, respectively, the $(m+1)^{th}$ gate signal and the $(m+3)^{th}$ gate signal being supplied to the $(m+1)^{th}$ gate line and the $(m+3)^{th}$ gate line, respectively.

34 Claims, 6 Drawing Sheets

LIQUID CRYSTAL DISPLAY DEVICE AND METHOD OF DRIVING THE SAME

CROSS-REFERENCE TO RELATED APPLICATION

This Nonprovisional Application claims priority under 35 U.S.C. §119(a) on Patent Application No. 10-2006-0025222 filed in Korea on Mar. 20, 2006, the entire contents of which are hereby incorporated by reference.

BACKGROUND OF THE INVENTION

1. Field of the Invention

The present invention relates to a liquid crystal display (LCD) device, and more particularly, to a double pixel gate in panel (DGIP) type LCD device and a method of driving the DGIP type LCD device.

2. Discussion of the Related Art

Liquid crystal display (LCD) devices are widely used as monitors for laptop computers and desktop computers because of their high resolution, high contrast ratio, color rendering capability and superiority in displaying moving images. An LCD device relies on optical anisotropy and polarizability of liquid crystal molecules to produce an image. An LCD device includes a liquid crystal display (LCD) panel having two substrates and a liquid crystal layer interposed therebetween and a backlight assembly supplying light to the LCD panel. The liquid crystal molecules are aligned along the direction of an electric field generated between electrodes formed on the two respective substrates of the LCD panel. By refracting and transmitting incident light from a backlight assembly below an LCD panel and controlling the electric field applied to a group of liquid crystal molecules within particular pixel regions, a desired image can be obtained.

Of the different types of known liquid crystal display (LCD) devices, active matrix LCD (AM-LCD) devices, which have thin film transistors (TFTs) and pixel electrodes arranged in a matrix form, are the subjects of significant research and development because of their high resolution and superior ability in displaying moving images.

FIG. 1 is a schematic block diagram showing a liquid crystal display device according to the related art. In FIG. 1, a liquid crystal display (LCD) device includes an LCD panel 10 and a driving circuit unit 20. The LCD panel 10 displays images and the driving circuit unit 20 supplies several electric signals for displaying images to the LCD panel 10.

The LCD panel 10 includes a first substrate, a second substrate and a liquid crystal layer between the first and second substrates. Gate lines 12 and data lines 14 are formed on the first substrate, which is referred to as an array substrate. The gate line 12 crosses the data line 14 to define a pixel region "P." A thin film transistor (TFT) "T" is connected to the gate line 12 and the data line 14, and a pixel region connected to the TFT "T" is formed in the pixel region "P." A color filter layer including red, green and blue color filters is formed on the second substrate, which is referred as to a color filter substrate. A common electrode is formed on the color filter layer. The liquid crystal layer constitutes a liquid crystal capacitor "Clc" with the pixel electrode and the common electrode.

The driving circuit unit 20 includes an interface 22, a timing controller 24, a gate driver 26, a data driver 28, a reference voltage generator 30 and a source voltage generator 32. The interface 22 transmits signals from an external driving system such as a computer to the timing controller 24. The timing controller 24 treats the signals to supply a data signal, a data control signal and a gate control signal to the gate and data drivers 26 and 28. The gate and data drivers 26 and 28 are connected to the gate and data lines 12 and 14, respectively. The gate driver 26 generates a gate signal for turning on/off the TFT "T" of the LCD panel 10 using the gate control signal from the timing controller 24, and the gate lines 12 are sequentially enabled by the gate signals in each frame. The data driver 28 generates gamma voltages using the data signal and the data control signal from the timing controller 24, and the gamma voltages are supplied to the data lines 14. As a result, when the TFT "T" is turned on by the gate signal, the gamma voltage corresponding to the data signal is supplied to the corresponding pixel electrode through the TFT "T," and an electric field generated between the pixel electrode and common electrode drives the liquid crystal layer.

The reference voltage generator 30 generates a gamma reference voltage for a digital to analog converter (DAC) of the data driver 28. In addition, the source voltage generator 32 generates a source voltage for elements of the driving unit 20 and a common voltage for the LCD panel 10.

In an LCD device, when a direct current (DC) voltage is applied to the liquid crystal layer for a long time section, polar impurities in the liquid crystal layer are fixed to interfaces between the liquid crystal layer and one of the first and second substrates due to the electric field. Accordingly, a pretilt angle of the liquid crystal molecules is changed and the liquid crystal layer is not controlled as required, which deteriorate the display quality. To prevent the above deterioration, the LCD device is driven by an inversion method where the polarity of the data signal is inverted in each frame.

FIG. 2 is a timing chart showing signals supplied to a liquid crystal display device according to the related art. In FIG. 2, a common voltage "Vcom" is applied to a common electrode and a gate signal "Vgate" is applied to the gate lines. In addition, a data signal "Vdata" is applied to the data lines and is transmitted to pixel electrodes so that the pixel electrode has a pixel voltage. In the gate signal "Vgate" having a rectangular wave shape, a gate-high voltage "Vgh" and a gate-low voltage "Vgl" are alternately repeated. The gate-high voltage "Vgh" and the gate-low voltage "Vgl" correspond to a turn-on time section and a turn-off time section, respectively. The data signal "Vdata" has opposite polarities in two sequential frames. Accordingly, the data signal "Vdata" has a positive polarity (+) during the $t^{th}$ frame, while the data signal "Vdata" has a negative polarity (−) during the $(t+1)^{th}$ frame.

In addition, when the gate signal "Vgate" is changed from the gate-high voltage "Vgh" to the gate-low voltage "Vgl" at a border between the turn-on time section and the turn-off time section, the capacitance of the liquid crystal capacitor "Clc" and the pixel voltage are changed due to the charge re-distribution among the TFT "T," the liquid crystal capacitor "Clc" and a storage capacitor (not shown). A difference in the pixel voltage may be expressed as the following equation.

$$\Delta Vp=[Cgd/(Clc+Cst+Cgd)](Vgh-Vgl),$$

where ΔVp is a pixel voltage difference, Clc is a capacitance of the liquid crystal capacitor, Cst is a capacitance of the storage capacitor, Cgd is a capacitance of the parasitic capacitor of the TFT, and Vgh and Vgl are the gate-high voltage and the gate-low voltage, respectively.

The pixel voltage difference "ΔVp" has a deviation according to the position of the pixel electrode in the LCD panel. Accordingly, the pixel voltage is asymmetrically distorted due to the non-uniform pixel voltage difference "ΔVp," which causes the deviation in brightness. As a result, a display quality is degraded due to deterioration such as a flicker. To prevent the deterioration such as a flicker, a driving method where the gate signal "Vgate" is modulated according to a flicker signal having a rectangular wave shape has been suggested. In the driving method using a flicker signal, a rear portion of the gate signal "Vgate" in the turn-on time section has a voltage value lower than the gate-high voltage "Vgh" so that the pixel voltage difference "ΔVp" can be reduced.

An LCD device having a relatively low cost has been the subject of recent research and development. For the purpose of reducing the production cost, an LCD device having a reduced number of driving integrated circuits (ICs) has been suggested. For example, the reduction in the number of driving ICs may be obtained by reducing the number of data lines. Accordingly, a double pixel gate in panel (DGIP) type LCD device, where two adjacent pixel electrodes are connected to a single data line, has been suggested.

FIG. 3 is a schematic view showing a DGIP type LCD device according to the related art. In FIG. 3, a sub pixel region "Psub" and a pixel region "P" are defined in an LCD panel. Red, green and blue colors are displayed in three adjacent sub pixel regions "Psub," respectively, and the three adjacent sub pixel regions "Psub" constitute a single pixel region "P." The sub pixel regions "Psub" are arranged in a stripe shape where the subs pixel regions "Psub" displaying red "R," green "G" and blue "B" colors are sequentially repeated along a pixel row and the sub pixel regions displaying the same color are arranged along a pixel column in the LCD panel.

In addition, two adjacent sub pixel regions "Psub" along the pixel row have a single data line in common, and two gate lines are disposed between two adjacent sub pixel regions "Psub" along the pixel column. For example, the pixel row is disposed between the $m^{th}$ and $(m+1)^{th}$ gate lines "Gm" and "Gm+1" and between the $(m+2)^{th}$ and $(m+3)^{th}$ gate lines "Gm+2" and "Gm+3," while the $(m+1)^{th}$ and $(m+2)^{th}$ gate lines "Gm+1" and "Gm+2" are adjacent to each other without the pixel row.

In the LCD panel, a gate signal is sequentially supplied to the gate lines "G1, . . . , Gm, Gm+1, Gm+2, . . . " and a TFT connected to the selected gate line is turned on. Accordingly, a data signal is supplied to the data lines "D1, D2, D3 . . . " and the sub pixel regions "Psub" are driven by the data signal to display a corresponding color.

FIG. 4 is a schematic timing chart showing gate signals and a flicker signal supplied to an LCD device according to the related art. As shown in FIGS. 3 and 4, the $m^{th}$, $(m+1)^{th}$, $(m+2)^{th}$ and $(m+3)^{th}$ gate signals "Vgm," "Vgm+1," "Vgm+2" and "Vgm+3" are supplied to the $m^{th}$, $(m+1)^{th}$, $(m+2)^{th}$ and $(m+3)^{th}$ gate lines "Gm," "Gm+1," "Gm+2" and "Gm+3," respectively. The pixel regions "P" in the pixel row may be classified into odd pixel regions "Po" and even pixel regions "Pe" with the left outermost pixel column as a reference. Accordingly, in the pixel row between the $m^{th}$ and $(m+1)^{th}$ gate lines "Gm" and "Gm+1," the red and blue sub pixel regions "Ro" and "Bo" of the odd pixel regions "Po" and the green sub pixel regions "Ge" of the even pixel region "Pe" are driven by the $m^{th}$ gate signal "Vgm" of the $m^{th}$ gate line "Gm." Further, the green sub pixel regions "Go" of the odd pixel regions "Po" and the red and blue sub pixel regions "Re" and "Be" of the even pixel regions "Pe" are driven by the $(m+1)^{th}$ gate signal "Vgm+1" of the $(m+1)^{th}$ gate line "Gm+1." Similarly, in the pixel row between the $(m+2)^{th}$ and $(m+3)^{th}$ gate lines "Gm+2" and "Gm+3," the red and blue sub pixel regions "Ro" and "Bo" of the odd pixel regions "Po" and the green sub pixel regions "Ge" of the even pixel region "Pe" are driven by the $(m+2)^{th}$ gate signal "Vgm+2" of the $(m+2)^{th}$ gate line "Gm+2." Further, the green sub pixel regions "Go" of the odd pixel regions "Po" and the red and blue sub pixel regions "Re" and "Be" of the even pixel regions "Pe" are driven by the $(m+3)^{th}$ gate signal "Vgm+3" of the $(m+3)^{th}$ gate line "Gm+3."

The $m^{th}$ and $(m+2)^{th}$ gate signals "Vgm" and "Vgm+2" have a time difference of one period "T," and the $(m+1)^{th}$ and $(m+3)^{th}$ gate signals "Vgm+1" and "Vgm+3" have a time difference of one period "T." In addition, the $m^{th}$ and $(m+1)^{th}$ gate signals "Vgm" and "Vgm+1" have a time difference of a half period "T/2." As a result, the $m^{th}$, $(m+1)^{th}$, $(m+2)^{th}$ and $(m+3)^{th}$ gate signals "Vgm," "Vgm+1, "Vgm+2" and "Vgm+3" are sequentially delayed by the half period "T/2."

The $m^{th}$, $(m+1)^{th}$, $(m+2)^{th}$ and $(m+3)^{th}$ gate signals "Vgm," "Vgm+1," "Vgm+2" and "Vgm+3" are modulated according to a flicker signal "FLK" to prevent deterioration such as a flicker. Since the flicker signal "FLK" is synchronized with the $m^{th}$ gate signal "Vgm," the $m^{th}$ and $(m+2)^{th}$ gate signals "Vgm" and "Vgm+2" having the one period "T" are modulated such that rear portions "a" of the $m^{th}$ and $(m+2)^{th}$ gate signals "Vgm" and "Vgm+2" in the turn-on time section have a voltage value lower than the gate-high voltage "Vgh." As a result, the deterioration such as a flicker is prevented in the sub pixel regions "Psub" connected to the $m^{th}$ and $(m+2)^{th}$ gate lines "Gm" and "Gm+2." However, the $(m+1)^{th}$ and the $(m+3)^{th}$ gate signals "Vgm+1" and "Vgm+3," which have a time difference of the half period "T/2" with respect to the $m^{th}$ and $(m+2)^{th}$ gate signals "Vgm" and "Vgm+2," respectively, are modulated according to the flicker signal "FLK" such that front potions of the $(m+1)^{th}$ and $(m+3)^{th}$ gate signals "Vgm+1" and "Vgm+3" in the turn-on time section have a voltage value lower than the gate-high voltage "Vgh." The deterioration such as a flicker is not prevented by the gate signal modulation in the front portion of the turn-on time section. Instead, the gate signal modulation in the front portion of the turn-on time section causes brightness reduction in the sub pixel regions "Psub" connected to the $(m+1)^{th}$ and $(m+3)^{th}$ gate lines "Gm+1" and "Gm+3," thereby degrading the display quality.

SUMMARY OF THE INVENTION

Accordingly, the present invention is directed to a liquid crystal display device and a method of driving the same that substantially obviate one or more of the problems due to limitations and disadvantages of the related art.

An object of the present invention is to provide a liquid crystal device where the display quality degradation due to an erroneous gate signal modulation is prevented and a method of driving the liquid crystal display device using a flicker signal.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes: a liquid crystal panel; a $m^{th}$ gate line, a $(m+1)^{th}$ gate line, a $(m+2)^{th}$ gate line and a $(m+3)^{th}$ gate line in the liquid crystal panel, wherein m is a natural number; at least one data line crossing the $m^{th}$ gate line, the $(m+1)^{th}$ gate line, the $(m+2)^{th}$ gate line and the $(m+3)^{th}$ gate line; a timing controller generating a data signal, a control signal, a first flicker signal and a second flicker signal; a gate driver generating a $m^{th}$ gate signal and a $(m+2)^{th}$ gate signal using the first flicker signal and generating a $(m+1)^{th}$ gate signal and a $(m+3)^{th}$ gate signal using the second flicker signal, the $m^{th}$ gate signal and the $(m+2)^{th}$ gate signal being supplied to the $m^{th}$ gate line and the $(m+2)^{th}$ gate line, respectively, the $(m+1)^{th}$ gate signal and the $(m+3)^{th}$ gate signal being supplied to the $(m+1)^{th}$ gate line and the $(m+3)^{th}$ gate line, respectively.

In another aspect, as embodied, a method of driving a liquid crystal display device including a $m^{th}$ gate line, a $(m+1)^{th}$ gate line, a $(m+2)^{th}$ gate line, a $(m+3)^{th}$ gate line and at least one data line crossing the $m^{th}$ gate line, the $(m+1)^{th}$ gate line, the $(m+2)^{th}$ gate line and the $(m+3)^{th}$ gate line, includes: supplying a $m^{th}$ gate signal and a $(m+2)^{th}$ gate signal modulated with a first flicker signal to the $m^{th}$ gate line and the $(m+2)^{th}$ gate line, respectively; and supplying a $(m+1)^{th}$ gate signal and a $(m+3)^{th}$ gate signal modulated with a second flicker signal to the $(m+1)^{th}$ gate line and the $(m+3)^{th}$ gate line, respectively.

In another aspect, as embodied, a driver for a liquid crystal display device, includes: a timing controller generating a first flicker signal and a second flicker signal; and a gate driver generating a $m^{th}$ gate signal and a $(m+2)^{th}$ gate signal using the first flicker signal and generating a $(m+1)^{th}$ gate signal and a $(m+3)^{th}$ gate signal using the second flicker signal, the $m^{th}$ gate signal and the $(m+2)^{th}$ gate signal being supplied to a $m^{th}$ gate line and a $(m+2)^{th}$ gate line, respectively, the $(m+1)^{th}$ gate signal and the $(m+3)^{th}$ gate signal being supplied to a $(m+1)^{th}$ gate line and a $(m+3)^{th}$ gate line, respectively, wherein m is a natural number.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings. Wherever possible, similar reference numbers will be used to refer to the same or similar parts.

Figure 1:
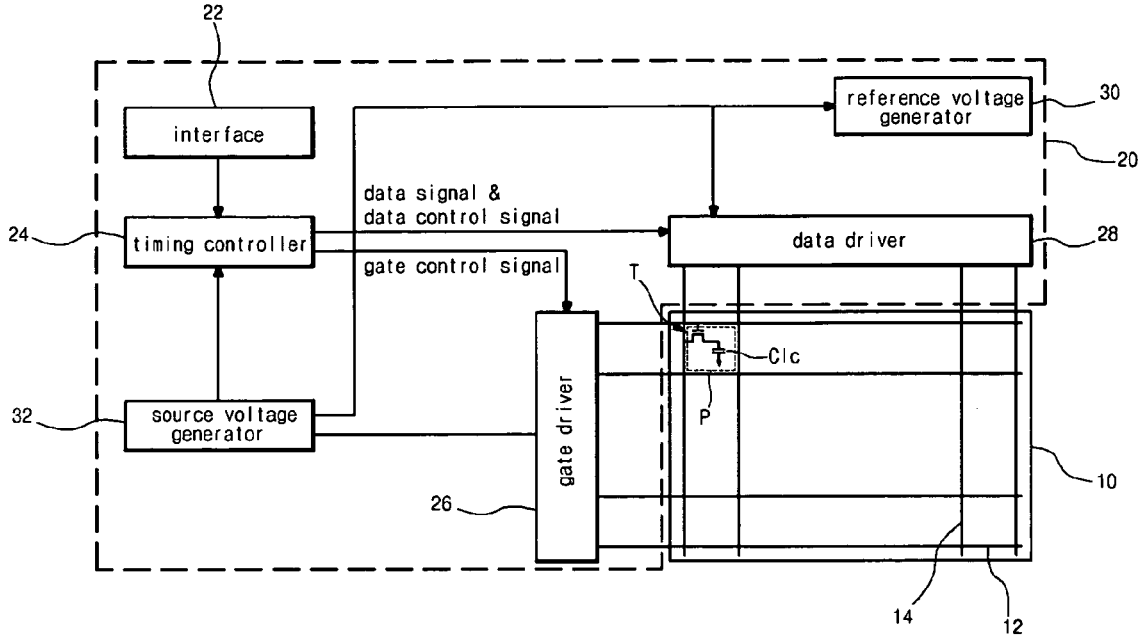
(Related Art) FIG. 1
FIG. 1 is a schematic block diagram showing a liquid crystal display device according to the related art.
Figure 2:
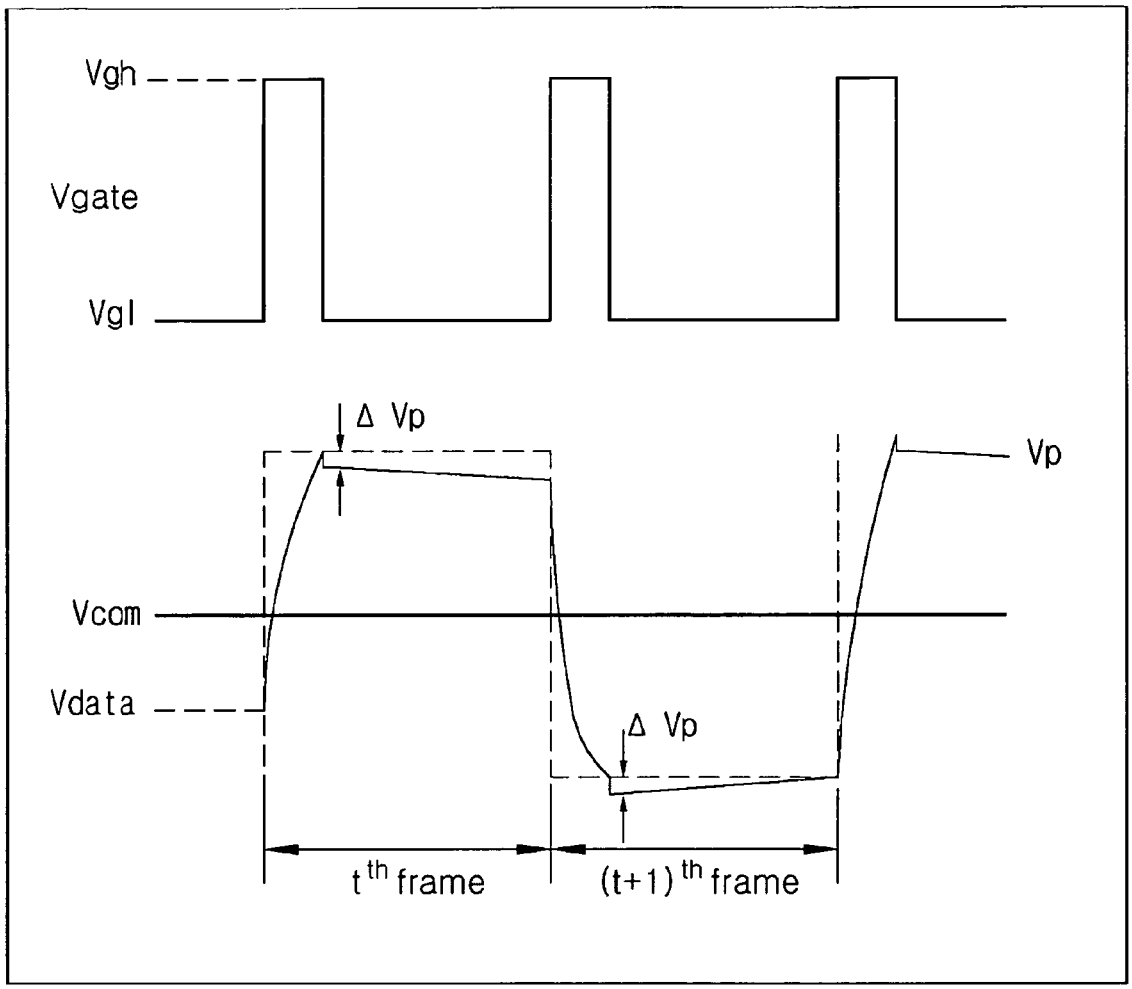
(Related Art) FIG. 2
FIG. 2 is a timing chart showing signals supplied to a liquid crystal display device according to the related art.
Figure 3:
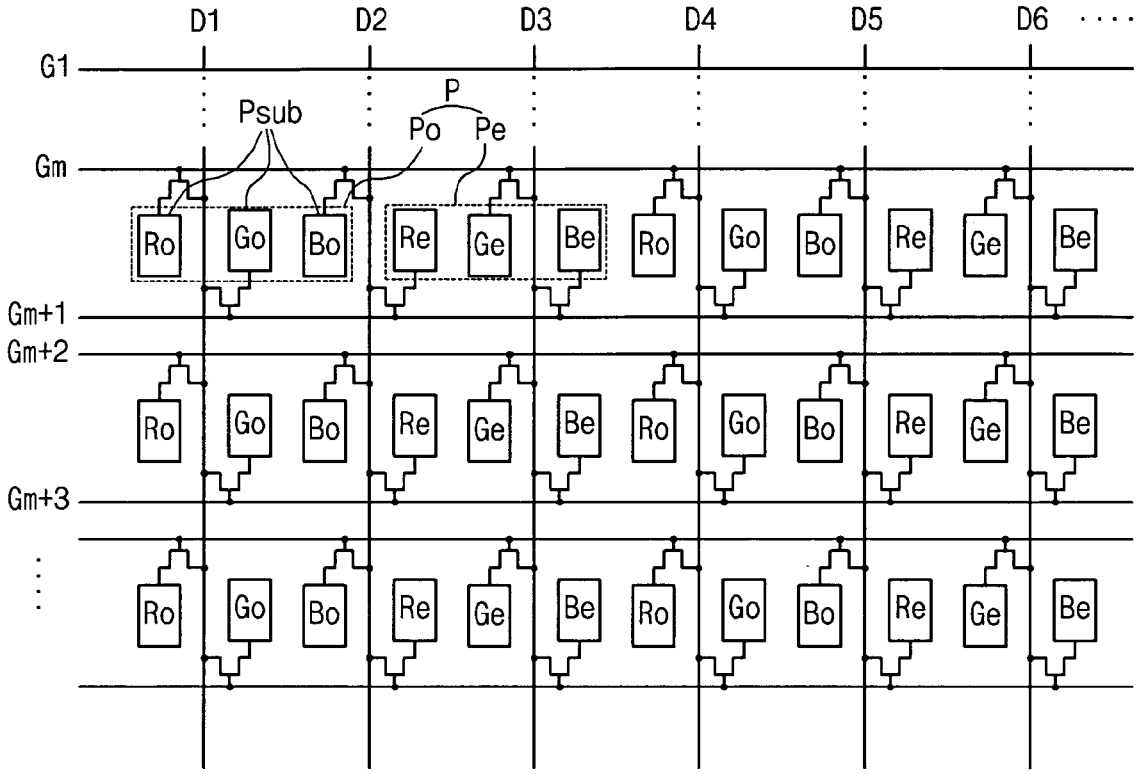
(Related Art) FIG. 3
FIG. 3 is a schematic view showing a DGIP type LCD device according to the related art.
Figure 4:
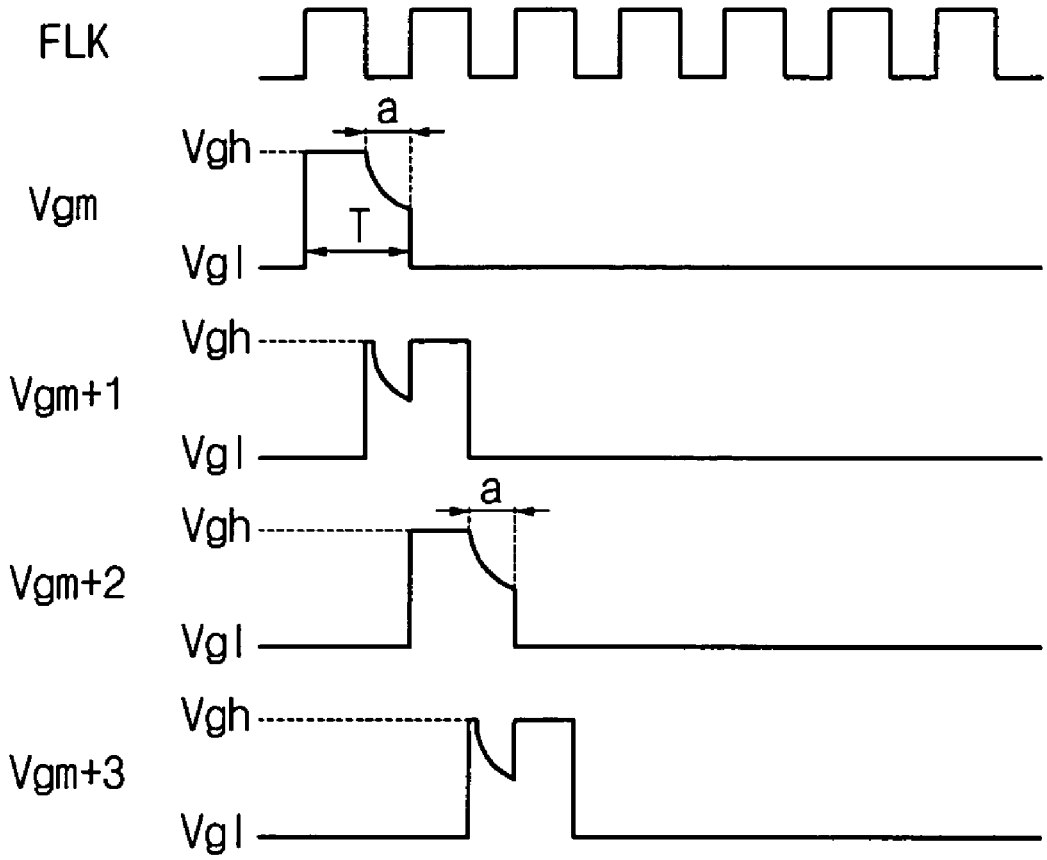
(Related Art) FIG. 4
FIG. 4 is a schematic timing chart showing gate signals and a flicker signal supplied to an LCD device according to the related art.
Figure 5:
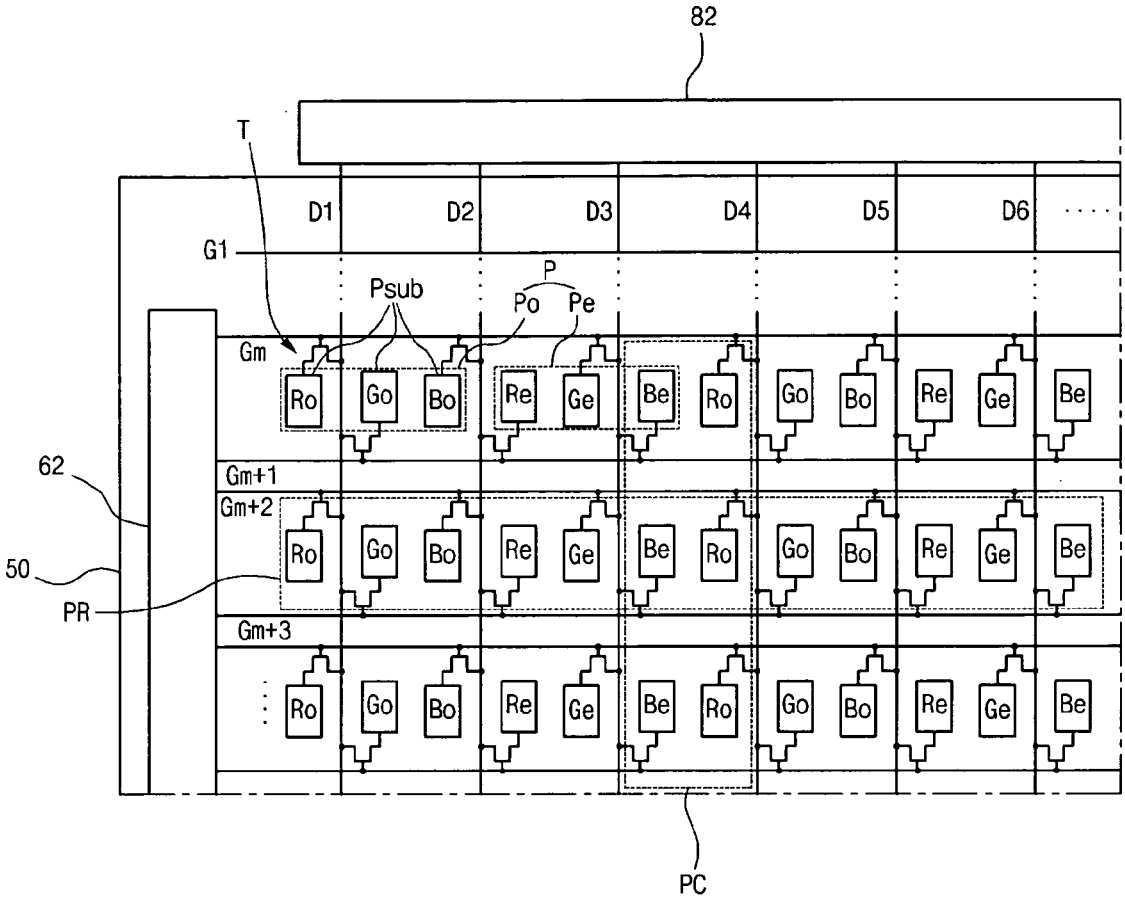
FIG. 5 is a schematic view showing a DGIP type LCD device according to an embodiment of the present invention.

FIG. 5 is a schematic view showing a DGIP type LCD device according to an embodiment of the present invention.

In FIG. 5, a liquid crystal display (LCD) device includes a liquid crystal display (LCD) panel 50 and a data driver 82 connected to the LCD panel 50. Since the LCD panel 50 has a double pixel gate in panel (DGIP) type, a gate driver 62 is integrated in the LCD panel 50. Although not shown in FIG. 5, the LCD panel 50 includes a first substrate, a second substrate and a liquid crystal layer between the first and second substrates. A plurality of gate lines "G1, . . . , Gm, Gm+1, Gm+2, Gm+3, . . ." and a plurality of data lines "D1, D2, D3, D4, . . ." are formed on the first substrate. The plurality of gate lines "G1, . . . , Gm, Gm+1, Gm+2, Gm+3, . . ." (m is a natural number) and the plurality of data lines "D1, D2, D3, D4, . . ." are arranged in a matrix manner to define pixel rows "PR" and pixel columns "PC." A thin film transistor (TFT) "T" is connected to the gate line and the data line, and a pixel electrode (not shown) is connected to the TFT "T." Although not shown in FIG. 5, a color filter layer having red, green and blue color filters and a common electrode are formed on the second substrate. The pixel electrode, the common electrode and the liquid crystal layer between the pixel electrode and the common electrode constitute a liquid crystal capacitor (not shown).

A sub pixel region "Psub" and a pixel region "P" are defined in the LCD panel 50. Red, green and blue colors are displayed in three adjacent sub pixel regions "Psub," respectively, and the three adjacent sub pixel regions "Psub" constitute the single pixel region "P." The sub pixel regions "Psub" are arranged in a stripe shape where the subs pixel regions "Psub" displaying red "R," green "G" and blue "B" colors are sequentially repeated in the pixel row "PR" and the sub pixel regions "Psub" displaying the same color are arranged in the same pixel column "PC."

In the LCD panel 50, two adjacent sub pixel regions "Psub" in the pixel row "PR" have a single data line in common, and two gate lines are disposed between two adjacent sub pixel regions "Psub" in the pixel column "PC." Accordingly, the two adjacent pixel columns "PC" are disposed at both sides of the single data line, and the two adjacent gate lines are disposed between the two adjacent pixel rows "PR." For example, the pixel row "PR" is disposed between the $m^{th}$ and $(m+1)^{th}$ gate lines "Gm" and "Gm+1" and between the $(m+2)^{th}$ and $(m+3)^{th}$ gate lines "Gm+2" and "Gm+3," while the $(m+1)^{th}$ and $(m+2)^{th}$ gate lines "Gm+1" and "Gm+2" are adjacent to each other without the pixel row "PR."

The pixel regions "P" in the pixel row "PR" may be classified into odd pixel regions "Po" and even pixel regions "Pe" with the left outermost pixel column as a reference. The odd and even pixel regions "Po" and "Pe" are alternately disposed in the pixel row "PR." Accordingly, in the pixel row "PR" between the $m^{th}$ and $(m+1)^{th}$ gate lines "Gm" and "Gm+1," the red and blue sub pixel regions "Ro" and "Bo" of the odd pixel regions "Po" and the green sub pixel regions "Ge" of the even pixel region "Pe" are connected to the $m^{th}$ gate line "Gm." Further, the green sub pixel regions "Go" of the odd pixel regions "Po" and the red and blue sub pixel regions "Re" and "Be" of the even pixel regions "Pe" are connected to the $(m+1)^{th}$ gate line "Gm+1." Similarly, in the pixel row between the $(m+2)^{th}$ and $(m+3)^{th}$ gate lines "Gm+2" and "Gm+3," the red and blue sub pixel regions "Ro" and "Bo" of the odd pixel regions "Po" and the green sub pixel regions "Ge" of the even pixel region "Pe" are connected to the $(m+2)^{th}$ gate line "Gm+2." Further, the green sub pixel regions "Go" of the odd pixel regions "Po" and the red and blue sub pixel regions "Re" and "Be" of the even pixel regions "Pe" are connected to the $(m+3)^{th}$ gate line "Gm+3."

In the pixel columns "PC," the red and green sub pixel regions "Ro" and "Go" of the odd pixel regions "Po" are connected to the first data line "D1." Further, the blue sub pixel region "Bo" of the odd pixel region "Po" and the red sub pixel region "Re" of the even pixel region "Pe" are connected to the second data line "D2," and the green and blue sub pixel regions "Ge" and "Be" of the even pixel region "Pe" are connected to the third data line "D3."

The plurality of gate lines "G1, . . . , Gm, Gm+1, Gm+2, Gm+3, . . . " are connected to the gate driver 62, and the plurality of data lines "D1, D2, D3, D4, . . . " are connected to the data driver 82. A gate signal is sequentially supplied to the gate lines "G1, . . . , Gm, Gm+1, Gm+2, Gm+3, . . . " and a TFT connected to the selected gate line is turned on. Accordingly, a data signal is supplied to the data lines "D1, D2, D3, D4, . . . " and the sub pixel regions "Psub" are driven by the data signal to display corresponding colors.

Figure 6:
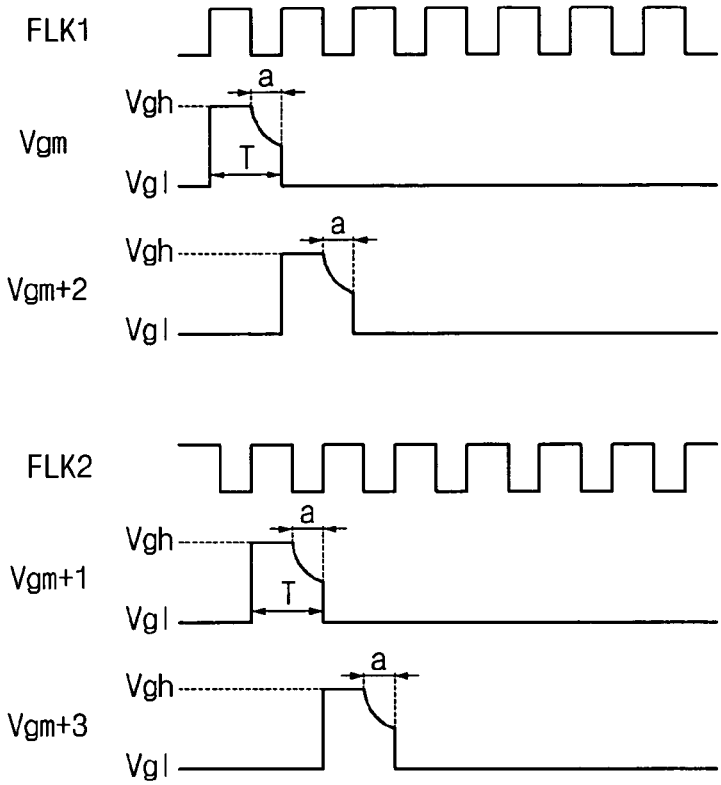
FIG. 6 is a schematic timing chart showing gate signals and a flicker signal supplied to an LCD device according to an embodiment of the present invention.

FIG. 6 is a schematic timing chart showing gate signals and a flicker signal supplied to an LCD device according to an embodiment of the present invention.

In FIGS. 5 and 6, the $m^{th}$, $(m+1)^{th}$, $(m+2)^{th}$ and $(m+3)^{th}$ gate signals "Vgm," "Vgm+1," Vgm+2 and Vgm+3" are supplied to the $m^{th}$, $(m+1)^{th}$, $(m+2)^{th}$ and $(m+3)^{th}$ gate lines "Gm," "Gm+1," "Gm+2" and "Gm+3," respectively. The $m^{th}$ and $(m+2)^{th}$ gate signals "Vgm" and "Vgm+2" have a time difference of a period "T," and the $(m+1)^{th}$ and $(m+3)^{th}$ gate signals "Vgm+1" and "Vgm+3" have a time difference of the period "T." In addition, the $m^{th}$ and $(m+1)^{th}$ gate signals "Vgm" and "Vgm+1" have a time difference of a half of the period "T." (T/2) As a result, the $m^{th}$, $(m+1)^{th}$, $(m+2)^{th}$ and $(m+3)^{th}$ gate signals "Vgm," "Vgm+1," "Vgm+2" and "Vgm+3" are sequentially delayed by the half of the period "T." (T/2)

Each of the gate signals "Vgm," "Vgm+1," "Vgm+2" and "Vgm+3" has a rectangular wave shape except for a rear portion of each of the gate signals. A gate-high voltage "Vgh" and a gate-low voltage "Vgl" are alternately repeated. The gate-high voltage "Vgh" and the gate-low voltage "Vgl" correspond to a turn-on time section and a turn-off time section, respectively. Accordingly, each of the gate signals "Vgm," "Vgm+1," "Vgm+2" and "Vgm+3" has a pulse repeated with a frame as a period.

The $m^{th}$, $(m+1)^{th}$, $(m+2)^{th}$ and $(m+3)^{th}$ gate signals "Vgm," "Vgm+1, "Vgm+2" and "Vgm+3" are obtained by modulating original gate signals (not shown) having a perfect rectangular wave shape using first and second flicker signals "FLK1" and "FLK2" from a timing controller (not shown). The original gate signals have the same timing as the modulated gate signals, respectively. The first and second flicker signals "FLK1" and "FLK2" have a rectangular wave shape and a time difference between the first and second flicker signals "FLK1" and "FLK2" is a half of the period "T." (T/2) In addition, the first and second flicker signals "FLK1" and "FLK2" are synchronized with the $m^{th}$ and $(m+1)^{th}$ gate signals "Vgm" and "Vgm+1," respectively. The first flicker signal "FLK1" is used for obtaining the $m^{th}$ and $(m+2)^{th}$ gate signals "Vgm" and "Vgm+2," and the second flicker signal "FLK2" is used for obtaining the $(m+1)^{th}$ and $(m+3)^{th}$ gate signals "Vgm+1" and "Vgm+3." Accordingly, an adjusted time section "a" of each of the $m^{th}$, $(m+1)^{th}$, $(m+2)^{th}$ and $(m+3)^{th}$ gate signals "Vgm," "Vgm+1," "Vgm+2" and "Vgm+3" in a rear portion of the turn-on time section has a voltage value lower than the gate-high voltage "Vgh" and higher than the gate-low voltage "Vgl."

Therefore, the $m^{th}$ and $(m+2)^{th}$ gate signals "Vgm" and "Vgm+2" are obtained by modulating $m^{th}$ and $(m+2)^{th}$ original gate signals using the first flicker signal "FLK1" synchronized with the $m^{th}$ gate signal "Vgm," and the $(m+1)^{th}$ and the $(m+3)^{th}$ gate signals "Vgm+1" and "Vgm+3" are obtained by modulating $(m+1)^{th}$ and the $(m+3)^{th}$ original gate signals using the second flicker signal "FLK2" synchronized with the $(m+1)^{th}$ gate signals "Vgm+1." Since the $(m+1)^{th}$ original gate signal having a time difference of the half of the period "T" (T/2) from the $m^{th}$ original gate signal is modulated using the second flicker signal "FLK2" having a time difference of the half of the period "T" (T/2) from the first flicker signal "FLK1," the $(m+1)^{th}$ gate signal "Vgm+1" has the adjusted time section "a" at the rear portion of the turn-on time section instead at the front portion of the turn-on time section as in the related art.

In the adjusted time section "a," each of the $m^{th}$, $(m+1)^{th}$, $(m+2)^{th}$ and $(m+3)^{th}$ gate signals "Vgm," "Vgm+1," "Vgm+2" and "Vgm+3" has a voltage value lower than the gate-high voltage "Vgh" to reduce the pixel voltage difference "ΔVp." For example, the voltage value of each of the $m^{th}$, $(m+1)^{th}$, $(m+2)^{th}$ and $(m+3)^{th}$ gate signals "Vgm," "Vgm+1," "Vgm+2" and "Vgm+3" in the adjusted time section "a" may vary along a curve connecting the gate-high voltage "Vgh" and a voltage between the gate-high and gate-low voltages "Vgh" and "Vgl." Thus, the voltage value of each of the $m^{th}$, $(m+1)^{th}$, $(m+2)^{th}$ and $(m+3)^{th}$ gate signals "Vgm," "Vgm+1," "Vgm+2" and "Vgm+3" may nonlinearly vary from the gate-high voltage "Vgh" to the voltage between the gate-high and gate-low voltages "Vgh" and "Vgl" in the adjusted time section "a."

In the LCD device according to an embodiment of the present invention, an erroneous gate signal modulation is prevented using the first and second flicker signals having a time difference of a half of the time period. As a result, deterioration such as a flicker is prevented and uniformity in brightness is improved.

Figure 7:
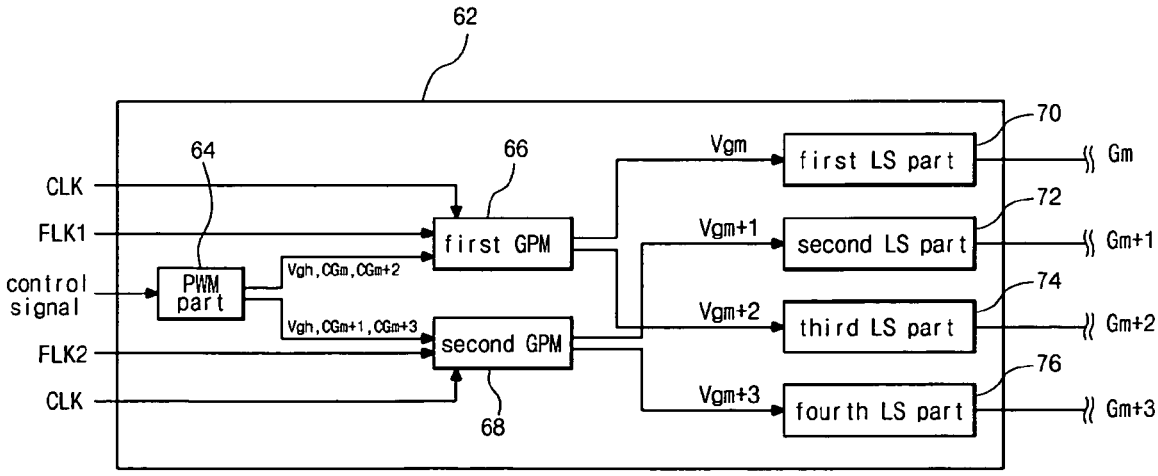
FIG. 7 is a schematic block diagram showing a gate driver in an LCD device according to an embodiment of the present invention.

FIG. 7 is a schematic block diagram showing a gate driver in an LCD device according to an embodiment of the present invention.

In FIG. 7, a gate driver 62 integrated in an LCD device includes a pulse width modulation (PWM) part 64, a first gate pulse modulation (GPM) part 66, a second GPM part 68, a first level shifter (LS) part 70, a second LS part 72, a third LS part 74 and a fourth LS part 76. The first, second, third and fourth LS parts 70, 72, 74 and 76 are connected to $m^{th}$, $(m+1)^{th}$, $(m+2)^{th}$ and $(m+3)^{th}$ gate lines "Gm," "Gm+1," "Gm+2" and "Gm+3," respectively. Although FIG. 7 show the gate driver 62 for the $m^{th}$, $(m+1)^{th}$, $(m+2)^{th}$ and $(m+3)^{th}$ gate lines "Gm," "Gm+1," "Gm+2" and "Gm+3," the gate driver may be similarly formed for the other gate lines.

The PWM part 64 treats a control signal from a timing controller (not shown) to generate first, second, third and fourth clocks "CGm," "CGm+1," "CGm+2" and "CGm+3" for original gate signals before modulation and a gate-high voltage "Vgh." The gate-high voltage "Vgh," the first clock "CGm" and the third clock "CGm+2" are transmitted to the first GPM part 66, while the gate-high voltage "Vgh," and the second clock "CGm+1" and the fourth clock "CGm+3" are transmitted to the second GPM part 68.

The first GPM part 66 generates $m^{th}$ and $(m+2)^{th}$ original gate signals (not shown) using the gate-high voltage "Vgh," the first clock "CGm" and the third clock "CGm+2" from the PWM part 64, and modulates the $m^{th}$ and $(m+2)^{th}$ original gate signals using the first flicker signal "FLK1" from the timing controller to generate $m^{th}$ and $(m+2)^{th}$ gate signals "Vgm" and "Vgm+2" each having an adjusted time section "a" at a rear portion of the turn-on time section. In addition, the second GPM part 68 generates $(m+1)^{th}$ and $(m+3)^{th}$ original gate signals (not shown) using the gate-high voltage "Vgh," the second clock "CGm+1" and the fourth clock "CGm+3" from the PWM part 64, and modulates the $(m+1)^{th}$ and $(m+3)^{th}$ original gate signals using the second flicker signal "FLK2" from the timing controller to generate $(m+1)^{th}$ and $(m+3)^{th}$ gate signals "Vgm+1" and "Vgm+3" each having an adjusted time section "a" at a rear portion of the turn-on time section. Additional clocks from the timing controller may be supplied to the first and second GPM parts 66 and 68.

The $m^{th}$ and $(m+2)^{th}$ gate signals "Vgm" and "Vgm+2" modulated by using the first flicker signal "FLK1" are supplied to the first and third LS parts 70 and 74, respectively. Voltage levels of the $m^{th}$ and $(m+2)^{th}$ gate signals "Vgm" and "Vgm+2" are changed in the in the first and third LS parts 70 and 74, respectively, and then the voltage level changed $m^{th}$ and $(m+2)^{th}$ gate signals "Vgm" and "Vgm+2" are supplied to the $m^{th}$ and $(m+2)^{th}$ gate lines "Gm" and "Gm+2," respectively. Similarly, the $(m+1)^{th}$ and $(m+3)^{th}$ gate signals "Vgm+1" and "Vgm+3" modulated by using the second flicker signal "FLK2" are supplied to the second and fourth LS parts 72 and 76, respectively. Voltage levels of the $(m+1)^{th}$ and $(m+3)^{th}$ gate signals "Vgm+1" and "Vgm+3" are changed in the in the second and fourth LS parts 72 and 76, respectively, and then the voltage level changed $(m+1)^{th}$ and $(m+3)^{th}$ gate signals "Vgm+1" and "Vgm+3" are supplied to the $(m+1)^{th}$ and $(m+3)^{th}$ gate lines "Gm+1" and "Gm+3," respectively.

Consequently, in the DGIP type LCD device according to the illustrated embodiments of the present invention, the display quality deterioration due to erroneous gate signal modulation is alleviated. Specifically, since the original gate signals having a time difference of a half of one period are modulated by two flicker signals having a time difference of the half of one period, respectively, each modulated gate signal has an adjusted time section at a rear portion of the turn-on time section. As a result, a flicker is prevented and uniformity in brightness is improved.

It will be apparent to those skilled in the art that various modifications and variations can be made in the liquid crystal display device and the method of driving the liquid crystal display device of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel;

a $m^{th}$ gate line, a $(m+1)^{th}$ gate line, a $(m+2)^{th}$ gate line and a $(m+3)^{th}$ gate line in the liquid crystal panel, wherein m is a natural number;

at least one data line crossing the $m^{th}$ gate line, the $(m+1)^{th}$ gate line, the $(m+2)^{th}$ gate line and the $(m+3)^{th}$ gate line;

a timing controller generating a data signal, a control signal, a first flicker signal and a second flicker signal;

a gate driver generating a $m^{th}$ gate signal and a $(m+2)^{th}$ gate signal using the first flicker signal and generating a $(m+1)^{th}$ gate signal and a $(m+3)^{th}$ gate signal using the second flicker signal, the $m^{th}$ gate signal and the $(m+2)^{th}$ gate signal being supplied to the $m^{th}$ gate line and the $(m+2)^{th}$ gate line, respectively, the $(m+1)^{th}$ gate signal and the $(m+3)^{th}$ gate signal being supplied to the $(m+1)^{th}$ gate line and the $(m+3)^{th}$ gate line, respectively.

2. The device according to claim 1, wherein the liquid crystal panel having pixel rows and pixel columns, the pixel rows are disposed between the $m^{th}$ gate line and the $(m+1)^{th}$ gate line and between the $(m+2)^{th}$ gate line and the $(m+3)^{th}$ gate line, and the pixel columns are disposed at both sides of the at least one data line.

3. The device according to claim 2, wherein each of the pixel rows includes red, green and blue sub pixel regions that are sequentially repeated, and each of the pixel columns includes one of the red, green and blue sub pixel regions.

4. The device according to claim 3, wherein the red, green and blue sub pixel region constitute one of odd and even pixel regions alternately disposed in each of the pixel rows, wherein the red and blue sub pixel regions of the odd pixel region and the green sub pixel regions of the even pixel region are connected to one of the $m^{th}$ gate line and the $(m+2)^{th}$ gate line, and wherein the green sub pixel regions of the odd pixel region and the red and blue sub pixel regions and of the even pixel region are connected to one of the $(m+1)^{th}$ gate line and $(m+3)^{th}$ gate line.

5. The device according to claim 4, wherein the at least one data line includes first, second and third data lines, wherein the red and green sub pixel regions of the odd pixel region are connected to the first data line, wherein the blue sub pixel region of the odd pixel region and the red sub pixel region of the even pixel region are connected to the second data line, and wherein the green and blue sub pixel regions and of the even pixel region are connected to the third data line.

6. The device according to claim 1, wherein the gate driver generates a $m^{th}$ original gate signal, a $(m+1)^{th}$ original gate signal, a $(m+2)^{th}$ original gate signal and a $(m+3)^{th}$ original gate signal, each of the original gate signals having a substantially rectangular wave shape, wherein the gate driver modulates the $m^{th}$ original gate signal and the $(m+2)^{th}$ original gate signal with the first flicker signal, and wherein the gate driver modulates the $(m+1)^{th}$ original gate signal and the $(m+3)^{th}$ original gate signal with the second flicker signal.

7. The device according to claim 6, wherein the gate driver comprising:

a pulse width modulation part generating a first clock, a second clock, a third clock, a fourth clock and a gate-high voltage;

a first gate pulse modulation part generating the $m^{th}$ original gate signal and the $(m+2)^{th}$ original gate signal using the gate-high voltage, the first clock and the third clock and modulating the $m^{th}$ original gate signal and the $(m+2)^{th}$ original gate signal using the first flicker signal to generate the $m^{th}$ gate signal and the $(m+2)^{th}$ gate signal; and a second gate pulse modulation part generating the $(m+1)^{th}$ original gate signal and the $(m+3)^{th}$ original gate signal using the gate-high voltage, the second clock and the fourth clock and modulating the $(m+1)^{th}$ original gate signal and the $(m+3)^{th}$ original gate signal using the second flicker signal to generate the $(m+1)^{th}$ gate signal and the $(m+3)^{th}$ gate signal.

8. The device according to claim 1, wherein each of the $m^{th}$ gate signal, the $(m+1)^{th}$ gate signal, the $(m+2)^{th}$ gate signal and the $(m+3)^{th}$ gate signal has a pulse shape, and has a gate-high voltage in a turn-on time section and a gate-low voltage in a turn-off time section, and wherein the turn-on time section and the turn-off time section are sequentially repeated.

9. The device according to claim 8, wherein the first flicker signal and the second flicker signal have a same period, wherein the $m^{th}$ gate signal and the $(m+2)^{th}$ gate signal have a time difference of the period, wherein the $(m+1)^{th}$ gate signal and the $(m+3)^{th}$ gate signal have a time difference of the period, and wherein the $m^{th}$ gate signal, the $(m+1)^{th}$ gate signal, the $(m+2)^{th}$ gate signal and the $(m+3)^{th}$ gate signal are sequentially delayed by a half of the period.

10. The device according to claim 9, wherein the first and second flicker signals have a substantially rectangular wave shape and have a time difference of the half of the period.

11. The device according to claim 10, wherein each of the $m^{th}$ gate signal, the $(m+1)^{th}$ gate signal, the $(m+2)^{th}$ gate signal and the $(m+3)^{th}$ gate signal has an adjusted time section at a rear portion of the turn-on time section, and wherein each of the $m^{th}$ gate signal, the $(m+1)^{th}$ gate signal, the $(m+2)^{th}$ gate signal and the $(m+3)^{th}$ gate signal at the rear portion of the turn-on time section has a voltage value lower than the gate-high voltage and higher than the gate-low voltage.

12. The device according to claim 1, further comprising a data driver generating and supplying an image signal to the at lease one data line using the data signal and the control signal.

13. The device according to claim 1, wherein the liquid crystal display device is a double-pixel-gate-in-panel (DGIP) liquid crystal display device.

14. The device according to claim 1, wherein the first flicker signal and the second flicker signal have a phase delay.

15. The device according to claim 14, wherein the first flicker signal and the second flicker signal have a same period, and the phase delay between the first flicker signal and the second flicker signal is a half of the period of the first flicker signal and the second flicker signal.

16. A method of driving a liquid crystal display device including a $m^{th}$ gate line, a $(m+1)^{th}$ gate line, a $(m+2)^{th}$ gate line, a $(m+3)^{th}$ gate line and at least one data line crossing the $m^{th}$ gate line, the $(m+1)^{th}$ gate line, the $(m+2)^{th}$ gate line and the $(m+3)^{th}$ gate line, the method comprising:

supplying a $m^{th}$ gate signal and a $(m+2)^{th}$ gate signal modulated with a first flicker signal to the $m^{th}$ gate line and the $(m+2)^{th}$ gate line, respectively; and supplying a $(m+1)^{th}$ gate signal and a $(m+3)^{th}$ gate signal modulated with a second flicker signal to the $(m+1)^{th}$ gate line and the $(m+3)^{th}$ gate line, respectively.

17. The method according to claim 16, wherein the first flicker signal and the second flicker signal have a same period, and wherein the $m^{th}$ gate signal, the $(m+1)^{th}$ gate signal, the $(m+2)^{th}$ gate signal and the $(m+3)^{th}$ gate signal are sequentially delayed by a half of the period.

18. The method according to claim 17, wherein the first and second flicker signals have a substantially rectangular wave shape and have a time difference of the half of the period.

19. The method according to claim 16, further comprising:

supplying an image signal to the data line; and applying the image signal to a sub pixel region connected to one of the $m^{th}$ gate line, the $(m+1)^{th}$ gate line, the $(m+2)^{th}$ gate line and the $(m+3)^{th}$ gate line while one of the $m^{th}$ gate signal, the $(m+1)^{th}$ gate signal, the $(m+2)^{th}$ gate signal and the $(m+3)^{th}$ gate signal are supplied to the one of the $m^{th}$ gate line, the $(m+1)^{th}$ gate line, the $(m+2)^{th}$ gate line and the $(m+3)^{th}$ gate line.

20. The method according to claim 16, further comprising:

generating a $m^{th}$ original gate signal, a $(m+1)^{th}$ original gate signal, a $(m+2)^{th}$ original gate signal and a $(m+3)^{th}$ original gate signal each having a substantially rectangular wave shape;

modulating the $m^{th}$ original gate signal and the $(m+2)^{th}$ original gate signal with the first flicker signal to generate the $m^{th}$ gate signal and the $(m+2)^{th}$ gate signal, respectively; and modulating the $(m+1)^{th}$ original gate signal and the $(m+3)^{th}$ original gate signal with the second flicker signal to generate the $(m+1)^{th}$ gate signal and the $(m+3)^{th}$ gate signal, respectively.

21. The method according to claim 16, wherein the first flicker signal and the second flicker signal have a phase delay.

22. The method according to claim 16, wherein the first flicker signal and the second flicker signal have a same period, and the phase delay between the first flicker signal and the second flicker signal is a half of the period of the first flicker signal and the second flicker signal.

23. The method according to claim 16, wherein the liquid crystal display device is a double-pixel-gate-in-panel (DGIP) liquid crystal display device.

24. A driver for a liquid crystal display device, comprising:

a timing controller generating a first flicker signal and a second flicker signal; and a gate driver generating a $m^{th}$ gate signal and a $(m+2)^{th}$ gate signal using the first flicker signal and generating a $(m+1)^{th}$ gate signal and a $(m+3)^{th}$ gate signal using the second flicker signal, the $m^{th}$ gate signal and the $(m+2)^{th}$ gate signal being supplied to a $m^{th}$ gate line and a $(m+2)^{th}$ gate line, respectively, the $(m+1)^{th}$ gate signal and the $(m+3)^{th}$ gate signal being supplied to a $(m+1)^{th}$ gate line and a $(m+3)^{th}$ gate line, respectively, wherein m is a natural number.

25. The driver according to claim 24, wherein the a timing controller generate a data signal and a control signal, the driver further comprising a data driver generating and supplying an image signal to at lease one data line using the data signal and the control signal.

26. The driver according to claim 24, wherein the driver is a driver for a double-pixel-gate-in-panel (DGIP) liquid crystal display device.

27. The driver according to claim 24, wherein the first flicker signal and the second flicker signal have a phase delay.

28. The driver according to claim 27, wherein the first flicker signal and the second flicker signal have a same period, and the phase delay between the first flicker signal and the second flicker signal is a half of the period of the first flicker signal and the second flicker signal.

29. The device according to claim 24, wherein the gate driver generates a $m^{th}$ original gate signal, a $(m+1)^{th}$ original gate signal, a $(m+2)^{th}$ original gate signal and a $(m+3)^{th}$ original gate signal, each of the original gate signals having a substantially rectangular wave shape, wherein the gate driver modulates the $m^{th}$ original gate signal and the $(m+2)^{th}$ original gate signal with the first flicker signal, and wherein the gate driver modulates the $(m+1)^{th}$ original gate signal and the $(m+3)^{th}$ original gate signal with the second flicker signal.

30. The device according to claim 29, wherein the gate driver comprising:

a pulse width modulation part generating a first clock, a second clock, a third clock, a fourth clock and a gate-high voltage;

a first gate pulse modulation part generating the $m^{th}$ original gate signal and the $(m+2)^{th}$ original gate signal using the gate-high voltage, the first clock and the third clock and modulating the $m^{th}$ original gate signal and the $(m+2)^{th}$ original gate signal using the first flicker signal to generate the $m^{th}$ gate signal and the $(m+2)^{th}$ gate signal; and a second gate pulse modulation part generating the $(m+1)^{th}$ original gate signal and the $(m+3)^{th}$ original gate signal using the gate-high voltage, the second clock and the fourth clock and modulating the $(m+1)^{th}$ original gate signal and the $(m+3)^{th}$ original gate signal using the second flicker signal to generate the $(m+1)^{th}$ gate signal and the $(m+3)^{th}$ gate signal.

31. The device according to claim 24, wherein each of the $m^{th}$ gate signal, the $(m+1)^{th}$ gate signal, the $(m+2)^{th}$ gate signal and the $(m+3)^{th}$ gate signal has a pulse shape, and has a gate-high voltage in a turn-on time section and a gate-low voltage in a turn-off time section, and wherein the turn-on time section and the turn-off time section are sequentially repeated.

32. The device according to claim 31, wherein the first flicker signal and the second flicker signal have a same period, wherein the $m^{th}$ gate signal and the $(m+2)^{th}$ gate signal have a time difference of the period, wherein the $(m+1)^{th}$ gate signal and the $(m+3)^{th}$ gate signal have a time difference of the period, and wherein the $m^{th}$ gate signal, the $(m+1)^{th}$ gate signal, the $(m+2)^{th}$ gate signal and the $(m+3)^{th}$ gate signal are sequentially delayed by a half of the period.

33. The device according to claim 32, wherein the first and second flicker signals have a substantially rectangular wave shape and have a time difference of the half of the period.

34. The device according to claim 33, wherein each of the $m^{th}$ gate signal, the $(m+1)^{th}$ gate signal, the $(m+2)^{th}$ gate signal and the $(m+3)^{th}$ gate signal has an adjusted time section at a rear portion of the turn-on time section, and wherein each of the $m^{th}$ gate signal, the $(m+1)^{th}$ gate signal, the $(m+2)^{th}$ gate signal and the $(m+3)^{th}$ gate signal at the rear portion of the turn-on time section has a voltage value lower than the gate-high voltage and higher than the gate-low voltage.

* * * * *